US008301068B2

(12) United States Patent
Kondoh et al.

(10) Patent No.: US 8,301,068 B2
(45) Date of Patent: Oct. 30, 2012

(54) FIXING MEMBER INCLUDING THROUGH-HOLES FORMED THROUGH RELEASE LAYER, METHOD FOR PRODUCING THE SAME, AND FIXING DEVICE

(75) Inventors: Tsuneaki Kondoh, Ayase (JP); Junichiro Natori, Yokohama (JP); Tomoaki Sugawara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 454 days.

(21) Appl. No.: 12/609,090

(22) Filed: Oct. 30, 2009

(65) Prior Publication Data

US 2010/0119269 A1 May 13, 2010

(30) Foreign Application Priority Data

Nov. 13, 2008 (JP) ..... 2008-291363
Jul. 10, 2009 (JP) ..... 2009-163493

(51) Int. Cl.
*G03G 15/20* (2006.01)

(52) U.S. Cl. ..... 399/333

(58) Field of Classification Search ..... 399/333, 399/320, 330, 122, 334, 335
See application file for complete search history.

(56) References Cited

U.S. PATENT DOCUMENTS

| | | | | |
|---|---|---|---|---|
| 5,217,532 | A * | 6/1993 | Sasame et al. | 118/60 |
| 6,911,240 | B2 | 6/2005 | Kondoh | |
| 7,146,126 | B2 | 12/2006 | Yoshii et al. | |
| 7,539,450 | B2 | 5/2009 | Aze et al. | |
| 2004/0224165 | A1 | 11/2004 | Kondoh et al. | |
| 2005/0095381 | A1 | 5/2005 | Kondoh | |
| 2006/0198666 | A1 | 9/2006 | Kondoh et al. | |
| 2008/0013996 | A1 * | 1/2008 | Ito | 399/333 |
| 2008/0063444 | A1 | 3/2008 | Kondoh et al. | |

FOREIGN PATENT DOCUMENTS

| | | |
|---|---|---|
| JP | 2001-83832 | 3/2001 |
| JP | 4015785 | 9/2007 |
| JP | 2007-316529 | 12/2007 |
| JP | 4137579 | 6/2008 |

* cited by examiner

*Primary Examiner* — Walter L Lindsay, Jr.
*Assistant Examiner* — Billy J Lactaoen
(74) *Attorney, Agent, or Firm* — Cooper & Dunham LLP

(57) ABSTRACT

To provide a fixing member for fixing to a recording medium an unfixed image formed with a developer, the fixing member including: a base material; an elastic layer which is provided outside the base material and has an elastic deformation property; and a release layer which is provided outside the elastic layer and promotes separation of the recording medium from the fixing member, wherein the release layer has a plurality of through-holes formed between its front surface and its surface on the opposite side to the front surface, and part of the elastic layer in contact with the release layer can fill the through-holes upon provision of pressure for fixing the unfixed image to the recording medium.

20 Claims, 6 Drawing Sheets

FIXING MEMBER INCLUDING THROUGH-HOLES FORMED THROUGH RELEASE LAYER, METHOD FOR PRODUCING THE SAME, AND FIXING DEVICE

BACKGROUND OF THE INVENTION

1. Field of the Invention

The present invention relates to a fixing member, a method for producing a fixing member, and a fixing device using the fixing member.

2. Description of the Related Art

Conventionally, electrophotographic image forming apparatuses, e.g. copiers, printers and facsimiles, generally include photoconductor drums which rotate, and a photosensitive layer of each photoconductor drum is uniformly charged and then exposed to a laser beam coming from a laser scanning unit so as to form a latent electrostatic image thereon. The latent electrostatic image is developed with toner and then transferred onto transfer paper that is a recording medium. Subsequently, the transfer paper is passed through a thermal fixation device where the developed image is thermally fixed on the transfer paper (thermal fixing method).

In full-color copiers and laser printers, toners of four colors, i.e. magenta (M), cyan (C), yellow (Y) and black (K), are used. When a color image is thermally fixed, it is necessary to mix these color toners in a melted state, so that there is a need to make the toners lower in melting point such that the toners can easily melt and to uniformly mix the several types of color toners in a combined manner and in a melted state on the surface of a heating and fixing roller.

In the thermal fixing method, since a toner image fused with a recording medium such as paper comes into contact with a fixing member, the outermost layer of the fixing member is formed of a material (e.g. fluorine resin) which is superior in separability. However, even when such a fixing member is used, the melting toner is liable to adhere to the surface of the fixing member owing to its softness and high viscosity, so that the winding of the recording medium such as paper may arise.

In recent years, demands for resource saving and energy saving have been heightening to protect the earth's environment, and there has been a tendency to reduce the melting point of toner in electrophotographic image forming apparatuses to save power consumption in accordance with the energy saving. Attempts are being made to use resins having relatively low molecular weights in order to reduce the melting point of toner; however, the toner becomes stickier when it melts, and thus a recording medium is more likely to be wound around the fixing member.

Accordingly, dispersion of a larger amount of wax in the toner, application of a larger amount of oil to the fixing member, and so forth are being considered to prevent the winding.

However, problems of serious side effects such as the following have been pointed out: when a large amount of wax is contained in the toner, the wax is highly likely to be exposed at the surface of the toner, which causes roller filming and/or a carrier-spent phenomenon; moreover, since a large amount of low-viscosity wax is mixed in the toner, offset arises owing to a reduction in the cohesive force of the overall toner. Although the problems such as roller filming and a carrier-spent phenomenon can be lessened by making a polymerized toner, etc. have a multilayer structure, the problem of the reduction in cohesive force cannot be prevented.

Further, there is a problem of smearing; for example, application of a large amount of oil can make paper sticky. This problem can be solved by reducing the amount of the oil applied; however, there is such a problem that when the amount is reduced in this manner, the oil is repelled by a release surface subjected to image fixation, the repelled oil is formed into the shape of dots and so cannot uniformly cover a fixation surface, and thus releasing effects are nullified.

Other known measures to prevent the winding include (1) a technique of feeding paper in the opposite direction to the fixation surface at the time of separation; and (2) a mechanical separation method such as addition of a member which induces forceful separation.

In using the member which induces forceful separation, there is generally a method employed in which a member called "separation claw" is brought into contact with a fixing member so as to prevent paper from being wound around the fixing member.

However, if the separation claw is brought into contact with the fixing member in this manner, the contact portion of the separation claw may scratch the fixing member, so that scratches may be transferred in a fixing step and an abnormal image may be thereby formed. Accordingly, ways of reducing the damaging behavior of the separation claw to the fixing member, for example by providing the separation claw with a fluorine-based resin surface layer superior in slidability or rounding angles in the vicinity of the contact portion of the separation claw, have been devised; however, when paper powder produced during printing is sandwiched between the separation claw and the fixing member, the paper powder is pressed against the fixing member by the separation claw, which too causes scratches, and thus an abnormal image may arise.

In recent years, along with the colorization, there has been a method of fixing toners of several colors, laid on top of one another over a recording medium, to the recording medium, in which a fixing member is used that includes a belt made of a polyimide or metal, an elastic layer made of silicone rubber or the like formed on the belt, and an adhesion preventing layer made of fluorine resin or the like to prevent adhesion of the toners. However, this fixing member is problematic in that a separation claw presses into the elastic layer further, thereby easily damaging the fixing member.

To solve the above-mentioned problems, there has, for example, been proposed a method (separation plate method) (refer to Japanese Patent Application Laid-Open (JP-A) No. 2001-83832), which is a combination of a technique of feeding paper in the opposite direction to the fixation surface at the time of separation, and a member (separation plate) that promotes separation of a recording medium such as paper from the fixing member while not in contact with the fixing member. Use of such a separation plate makes it possible to promote separation between the recording medium and the fixing member without scratching the fixing member.

In the separation plate method, however, an initial separating function is dependent upon the elasticity of paper, so that when the linear velocity is high, initial separation often does not take place in time. In other words, when the recording medium such as paper is electrostatically or chemically attached to the fixing member, there is a great reduction in separating function, and the separating performance tends to be insufficient especially at high linear velocity. In the case where a copy pattern with a large amount of adhesive toner is used, initial separation does not take place in time, which causes an image portion to touch the separation plate, and thus an image defect such as formation of streaks arises. Consequently, as the linear velocity increases, there is a paper jam caused on the separation plate. For that reason, the separation plate method is selectively used for copiers of low linear velocity and copiers of intermediate linear velocity.

Meanwhile, Japanese Patent (JP-B) No. 4015785 describes improvement in surface adhesion by forming fluorine resin protrusions on a fluorine rubber surface layer; however, serious temporal deformation arises owing to abrasions to the protrusions caused by the contact with recording media, dust, etc., and thus long-term stable effects cannot be obtained.

JP-A No. 2007-316529 describes provision of depressions capable of holding wax components as a release agent of toner; however, since the shape is obtained merely by processing the surface of a single member (having an equal hardness), a change cannot be produced in wettability, and thus the wax holding force is weak. Also, in some cases, the fixed surface shape is transferred to an output image, thereby reducing the glossiness of the image and lowering the image quality.

Therefore, in reality, the following have not yet been provided: a fixing member which surely promotes separation of a recording medium from the fixing member even at high speed, which can reduce the incidence of image defects and paper jams and form a high-quality image, and which undergoes less temporal deformation; a method for producing a fixing member; and a fixing device using the fixing member, which is capable of realizing stable image fixation for a long period of time.

BRIEF SUMMARY OF THE INVENTION

The present invention is aimed at solving the problems in related art and achieving the following object. An object of the present invention is to provide a fixing member which surely promotes separation of a recording medium from the fixing member even at high speed, which can reduce the incidence of image defects and paper jams and form a high-quality image, and which undergoes less temporal deformation; a method for producing a fixing member; and a fixing device using the fixing member, which is capable of realizing stable image fixation for a long period of time.

As a result of carrying out a series of earnest examinations in an attempt to solve the problems, the present inventors have found that by forming numerous through-holes (hereinafter, otherwise referred to as "depressions") in a release layer of a fixing member which are different from other portions (protrusions) in terms of affinity for a release agent in toner and which can deform by pressure, it is possible to surely promote separation of a recording medium from the fixing member even at high speed, reduce the incidence of image defects and paper jams and form a high-quality image.

The present invention is based upon the findings of the present inventors, and means for solving the problems are as follows.

<1> A fixing member for fixing to a recording medium an unfixed image formed with a developer, the fixing member including: a base material; an elastic layer which is provided outside the base material and has an elastic deformation property; and a release layer which is provided outside the elastic layer and promotes separation of the recording medium from the fixing member, wherein the release layer has a plurality of through-holes formed between its front surface and its surface on the opposite side to the front surface, and part of the elastic layer in contact with the release layer can fill the through-holes upon provision of pressure for fixing the unfixed image to the recording medium.

The fixing member according to <1> includes an elastic layer and a release layer, wherein the release layer has a plurality of through-holes formed between its front surface and its surface on the opposite side to the front surface, and part of the elastic layer in contact with the release layer fills the through-holes upon provision of pressure for fixing the unfixed image to the recording medium. When this fixing member is used in a fixing device of an image forming apparatus, it is possible to realize an image fixing and medium separating process in a stable manner without causing the winding of a recording medium and obtain a highly glossy, high-quality image without increasing the roughness of the image surface at the time of nipping with pressurization for image fixation.

<2> The fixing member according to <1>, wherein the part of the elastic layer in contact with the release layer fills the through-holes upon the provision of the pressure for fixing the unfixed image to the recording medium, and the front surface of the release layer forms a smooth surface when the unfixed image is pressurized for its fixation.

<3> The fixing member according to one of <1> and <2>, wherein the base material in the fixing member has a hollow structure in a cylindrical shape, and a heating medium is provided in the hollow structure.

<4> The fixing member according to any one of <1> to <3>, wherein a material constituting the release layer contains a fluorine-based polymer.

<5> The fixing member according to any one of <1> to <4>, wherein a material constituting the elastic layer is a rubber material.

<6> The fixing member according to <5>, wherein the rubber material has a molecular arrangement whose main-chain component contains siloxane bonds.

<7> The fixing member according to one of <5> and <6>, wherein the rubber material is fluorosilicone rubber.

<8> The fixing member according to any one of <1> to <7>, wherein the universal hardness of the elastic layer is equal to or lower than the universal hardness of the release layer.

Regarding the fixing member according to <8>, the universal hardness of the elastic layer is equal to or lower than the universal hardness of the release layer. Thus, when this fixing member is used in a fixing unit of an image forming apparatus, it is possible to realize an image fixing and medium separating process in a stable manner without causing the winding of a recording medium and obtain a highly glossy, high-quality image without increasing the roughness of the image surface at the time of nipping with pressurization for image fixation.

<9> The fixing member according to <8>, wherein the difference between the universal hardness of the release layer and the universal hardness of the elastic layer is in the range of 0 $N/mm^2$ to 3.75 $N/mm^2$.

<10> The fixing member according to any one of <1> to <9>, wherein the receding contact angle of a surface of the elastic layer to purified water is smaller than the receding contact angle of a surface of the release layer to purified water.

<11> The fixing member according to <10>, wherein the difference between the receding contact angle of the surface of the release layer to purified water and the receding contact angle of the surface of the elastic layer to purified water is in the range of 0.1° to 70°.

<12> The fixing member according to any one of <1> to <11>, wherein the base material has a thickness of 30 μm to 500 μm.

<13> The fixing member according to any one of <1> to <12>, wherein the release layer has a thickness of 0.01 μm to 5 μm.

<14> The fixing member according to any one of <1> to <13>, wherein the through holes have a diameter of 0.0001 mm to 1 mm each.

<15> The fixing member according to any one of <1> to <14>, wherein the ratio of the total area of the through holes to the overall area of the release layer is in the range of 0.001:1 to 0.6:1.

<16> A method for producing a fixing member, including: forming an elastic layer on a base material; attaching powder onto the elastic layer; forming a release layer over the powder; and removing the powder from a front surface of the release layer so as to form a plurality of through holes in the release layer.

<17> The method according to <16>, wherein the powder is removed by rubbing the front surface of the release layer with a dry cloth.

<18> The method according to one of <16> and <17>, wherein the powder has an average particle diameter of 0.2 μm to 50 μm.

<19> The method according to one of <16> and <17>, wherein the amount of the powder attached is in the range of 83 g/m$^2$ to 166 g/m$^2$.

<20> A fixing device including the fixing member according to any one of <1> to <15>.

Since the fixing device according to <20> is provided with the fixing member of the present invention, the durability and reliability of the fixing device improve.

<21> A fixing method including: placing the release layer of the fixing member according to any one of <1> to <15> in such a direction that the release layer touches an unfixed image formed with a developer, when the unfixed image is fixed to a recording medium.

<22> An image forming apparatus including: a latent electrostatic image bearing member; a unit configured to form a latent electrostatic image on the latent electrostatic image bearing member; a developing unit configured to develop the latent electrostatic image using a toner so as to form a visible image; a transfer unit configured to transfer the visible image onto a recording medium; and a fixing unit configured to fix the transferred visible image to the recording medium, wherein the fixing unit is the fixing device according to <20>.

Since the image forming apparatus according to <22> includes the fixing unit (fixing device) of the present invention, it can be suitably utilized for electrophotographic copiers, facsimiles, laser beam printers, etc. with high durability and reliability, and can thus contribute to reduction in environmental loads and improvement in customer satisfaction.

According to the present invention, it is possible to solve the problems in related art and provide the following: a fixing member which surely promotes separation of a recording medium from the fixing member even at high speed, which can reduce the incidence of image defects and paper jams and form a high-quality image, and which undergoes less temporal deformation; a method for producing a fixing member; and a fixing device using the fixing member, which is capable of realizing stable image fixation for a long period of time.

Figure 1A:
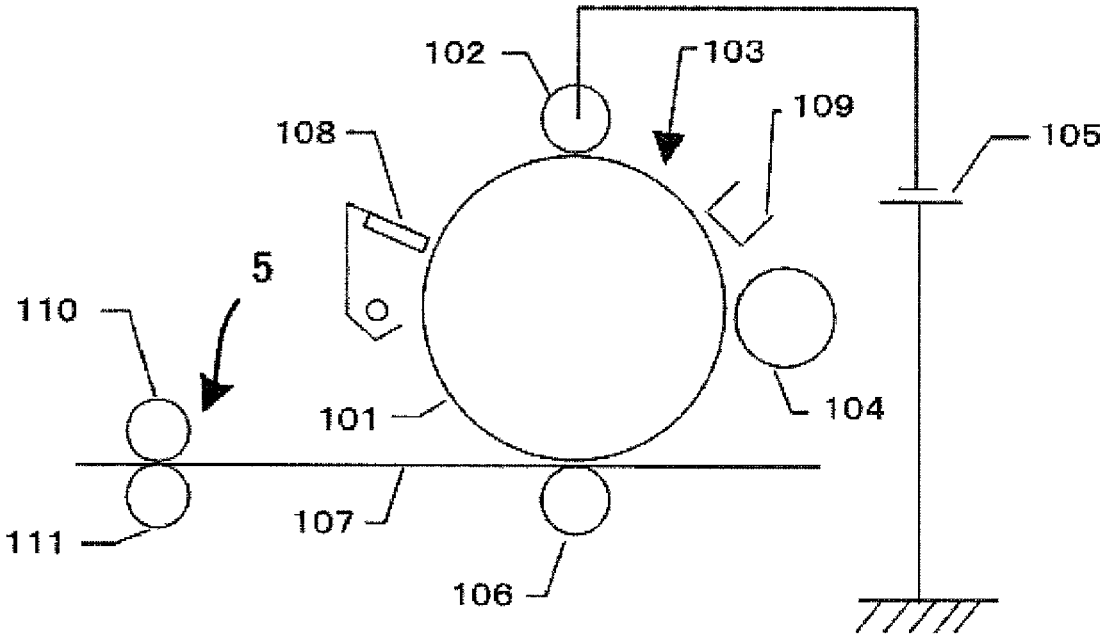
FIG. 1A is a drawing conceptually showing the structures of a photoconductor, an image forming system and a fixing device in an image forming apparatus.

DETAILED DESCRIPTION OF THE INVENTION (Fixing Member)

A fixing member of the present invention is a fixing member for fixing to a recording medium an unfixed image formed with a developer, the fixing member including: a base material; an elastic layer which is provided outside the base material and has an elastic deformation property; and a release layer which is provided outside the elastic layer and promotes separation of the recording medium from the fixing member. The fixing member may further include other layer(s) if necessary; for example, primer layer(s) may be formed between the layers and/or between the base material and the layer in the fixing member, and further, a modifying layer may be formed on a surface of the release layer to modify the quality of the surface.

In the present invention, the release layer has a plurality of through-holes formed between its front surface and its surface on the opposite side to the front surface, and part of the elastic layer in contact with the release layer fills the through-holes upon provision of pressure for fixing the unfixed image to the recording medium.

Here, the expression "pressure for fixing the unfixed image to the recording medium" means pressure at a site formed in a nipped manner between the fixing member and a pressurizing member placed opposite the fixing member, and the range of the pressure should be suitably set according to the structure but the pressure is preferably in the range of 5 N/cm$^2$ to 50 N/cm$^2$ as a surface pressure.

The release layer as the outermost layer has numerous through-holes which reach the elastic layer placed under the release layer. In other words, the release layer has the through-holes, at the bottoms of which the elastic layer is exposed; as seen in cross section, the release layer has a plurality of depressions contiguous to the elastic layer.

It is desirable that the part of the elastic layer in contact with the release layer fill the through-holes upon the provision of the pressure for fixing the unfixed image to the recording medium and that the front surface of the release layer form a smooth surface when the unfixed image is pressurized for its fixation, because a highly glossy image can be thereby obtained.

Here, the expression "the front surface of the release layer forms a smooth surface when the unfixed image is pressurized for its fixation" means that when a quartz plate (2 mm in thickness) is brought into contact with the front surface of the release layer of the fixing member by application of pressure (10 N/cm$^2$) and the height difference between a depression and a protrusion at the surface of the fixing member is measured in 10 places, the average height difference is 0.5 μm or less.

Placement of the release layer in such a direction that the release layer touches the unfixed image when the unfixed image is fixed to the recording medium is preferable in that adhesion of toner to the front surface of the release layer can be prevented and high image quality can be thereby obtained.

It is desirable that the universal hardness of the elastic layer be equal to or lower than the universal hardness of the release layer, and more desirable that the universal hardness of the elastic layer be lower than the universal hardness of the release layer.

When the universal hardness of the elastic layer is greater than that of the release layer, the front surface of the release layer may not form a smooth surface when the unfixed image is pressurized for its fixation, depending upon the thickness of the release layer, so that the image may increase in surface roughness and end up as a defective image.

Here, the universal hardness of the elastic layer and that of the release layer can be measured using a commercially available hardness tester, for example an ultra-micro hardness tester (WIN-HUD, manufactured by Fischer). In the case where the universal hardness is measured using the ultra-micro hardness tester, an indenter is gradually pushed against the fixing member to a predetermined depth under the following conditions, for example, and the universal hardness is calculated from the load and the contact area of the indenter at the time when the indenter has been pushed to the predetermined depth.

—Measurement Condition—

Indenter: diamond indenter in the shape of a quadrangular pyramid with a surface-facing angle of 136°

Initial load: 0.02 mN

Maximum load: 5 mN to 400 mN

Time spent in increasing load from initial load to maximum load: 10 seconds to 60 seconds The universal hardness of the elastic layer is not particularly limited and may be suitably selected according to the purpose but is preferably in the range of 0.05 N/mm$^2$ to 0.8 N/mm$^2$ (when the indenter has been pushed to a depth of 5 μm).

The universal hardness of the release layer is not particularly limited and may be suitably selected according to the purpose but is preferably in the range of 0.8 N/mm$^2$ to 4.0 N/mm$^2$ (when the indenter has been pushed to a depth of 5 μm).

The difference (A-B) between the universal hardness A of the release layer and the universal hardness B of the elastic layer is preferably in the range of 0 N/mm$^2$ to 3.75 N/mm$^2$.

It is desirable that the receding contact angle of a surface of the elastic layer to purified water be smaller than the receding contact angle of a surface of the release layer to purified water because the properties of a release agent contributing to improvement in the separability of melted toner can be thereby maintained.

The difference (C-D) between the receding contact angle C of the surface of the release layer to purified water and the receding contact angle D of the surface of the elastic layer to purified water is preferably in the range of 0.1° to 70°.

The receding contact angle of the surface of the elastic layer to purified water is preferably 30° or greater but less than 80°.

The receding contact angle of the surface of the release layer to purified water is preferably in the range of 80° to 100°.

Here, the receding contact angles can, for example, be measured using DROP MASTER DM 700 manufactured by Kyowa Interface Science Co., LTD. Note that the receding contact angle to the purified water is in proportion to the contact angle to the melted toner.

—Base Material—

The shape, structure, thickness, material, size and the like of the base material are not particularly limited and may be suitably selected according to the purpose.

The shape is not particularly limited and may be suitably selected according to the purpose. Examples of the shape include a plate-like shape, a belt-like shape and a cylindrical shape.

The structure is not particularly limited and may be suitably selected according to the purpose, and the structure may be a single-layer structure or a laminated structure.

The material is not particularly limited and may be suitably selected according to the purpose but is preferably heat-resistant. Examples of the material include resin and metal.

The resin is not particularly limited and may be suitably selected according to the purpose. Examples of the resin include polyimides, polyamide-imides, PEEK, PES, PPS and fluorine resins.

Magnetic conductive particles may be dispersed in these resins. In that case, the magnetic conductive particles are preferably added so as to occupy 20% by mass to 90% by mass of any of the resins. Specifically, the magnetic conductive particles are dispersed into a resin material in a varnish-like state by using a dispersing device such as a roll mill, a sand mill or a centrifugal defoaming device. The viscosity of the resin material with the magnetic conductive particles is appropriately adjusted using a solvent and then the mixture is shaped using a mold so as to have a desired thickness.

Examples of the metal include nickel, iron, chromium and alloys of such metals, and these may produce heat per se.

Among these, it is particularly desirable in terms of heating efficiency that the base material have a hollow structure in a cylindrical shape, and a heating medium be provided in the hollow structure.

Examples of the heating medium include a halogen heater, a ceramic heater and a metal roller capable of induction heating.

It is desirable in terms of heat capacity and strength that the base material have a thickness of 30 μm to 500 μm, more desirably 50 μm to 150 μm. In the case where the base material is made of a metal material and a fixing belt is used, it is desirable in view of the flexibility of the fixing belt that the base material have a thickness of 100 μm or less.

When the metal material is used, it is possible to obtain a desired Curie point by adjusting the amount of the material and process conditions, and by forming a heat-generating layer of a magnetic conductive material whose Curie point is in the vicinity of the fixation temperature of the fixing belt, the heat-generating layer can be heated without the temperature being excessively increased by electromagnetic induction.

—Elastic Layer—

The elastic layer is not particularly limited and may be suitably selected according to the purpose but is preferably a heat-resistant elastic material which exhibits more wettability to a release agent than to the release layer. Examples thereof include natural rubber, SBR, butyl rubber, chloroprene rubber, nitrile rubber, acrylic rubber, urethane rubber, silicone rubber, fluorosilicone rubber, fluorine rubber and liquid fluorine elastomers. Among these, elastic rubbers each having a molecular arrangement whose main-chain component contains siloxane bonds are preferable in terms of heat resistance, particularly silicone rubber, fluorosilicone rubber, fluorine rubber, fluorocarbon siloxane rubber and liquid fluorine elastomers, more particularly fluorosilicone rubber in terms of heat resistance and wettability to the release agent.

The method for forming the elastic layer is not particularly limited and may be suitably selected according to the purpose. Examples thereof include blade coating, roll coating and die coating. The thickness of the elastic layer is not particularly limited and may be suitably selected according to the purpose but is preferably in the range of 100 μm to 250 μm.

—Release Layer—

As the material for the release layer that is the outermost layer, any of the following substances may be used, for example: fluorine-based polymers such as tetrafluoroethylene resin (PTFE), tetrafluoroethylene-perfluoroalkyl vinyl ether copolymer resin (PFA) and tetrafluoroethylene-hexafluoropropylene copolymer (FEP); mixtures of these polymers; heat-resistant resins or rubbers in which these polymers are dispersed; and fluorine-based elastomers each having a fluorinated polyether in a cross-linking reactive group of silicone. Among these, substances each containing a fluorine-based polymer are particularly preferable in terms of keeping a balance between strength and smoothness.

The fluorine-based polymer is an amorphous resin having at least one functional group selected from hydroxyl group, silanol group, carboxyl group and a group which can be hydrolyzed. The amorphous resin of the release layer and the heat-resistant rubber of the elastic layer are bonded to each other via oxygen.

Examples of the amorphous resin include a resin having a perfluoropolyether in a main chain.

Examples of the group which can be hydrolyzed include alkoxy groups such as methoxy group and ethoxy group, and alkoxysilane groups such as methoxysilane group and ethoxysilane group.

A hollow filler, a conductive material, etc. may be added to the release layer as materials of low specific heat and low heat conductivity.

The method for forming the release layer is not particularly limited and may be suitably selected according to the purpose. Examples thereof include formation of a tube-shaped release layer over the elastic layer, wet spray coating, and formation by firing after the application of powder.

The release layer preferably has a thickness of 0.01 μm to 5 μm, more preferably 0.01 μm to 3 μm. When the release layer has a thickness of less than 0.01 μm, sufficient layer formability may not be secured because of the possible roughness of the elastic layer. When the release layer has a thickness of greater than 5 μm, level differences may be created on an image, and thus an image defect may arise because of differences in glossiness.

Here, the thickness of the release layer can, for example, be measured as a $SiO_2$ equivalent thickness by XPS. For the XPS, QUANTERA SXM (imaging XPS, manufactured by ULVAC-PHI, Inc) is used. As for XPS measurement conditions, a monochromatic AlKα ray (1486.6 eV, X-ray spot of 100 μm) is used as an X-ray, and a neutralization electron gun (1 eV) and an argon ion gun (7 eV) are used for charge correction at the time of the measurement. The measurement is carried out by making the X-ray enter from a direction set at an angle of 25° to a sample normal direction and detecting photoelectrons in a direction set at an angle of 20° to the sample normal direction. $C_{60}$ sputtering is carried out from a direction set at an angle of 70° to the sample normal direction, using a $C_{60}$ ion gun (PHI06-C60, manufactured by ULVAC-PHI, Inc). The acceleration voltage is 10 kV, and the sputtering rate is 1 nm/min in the case where $SiO_2$ is subjected to sputtering. For spectral analysis, MULTIPAK V6.1A (manufactured by ULVAC-PHI, Inc) is used. The sputtering is carried out such that the outermost layer is subjected to the sputtering first, and the layer thickness is determined by the point in time when a chemical shift related to the $CF_2$ bond in a spectrum (C1s) disappears.

Figure 2:
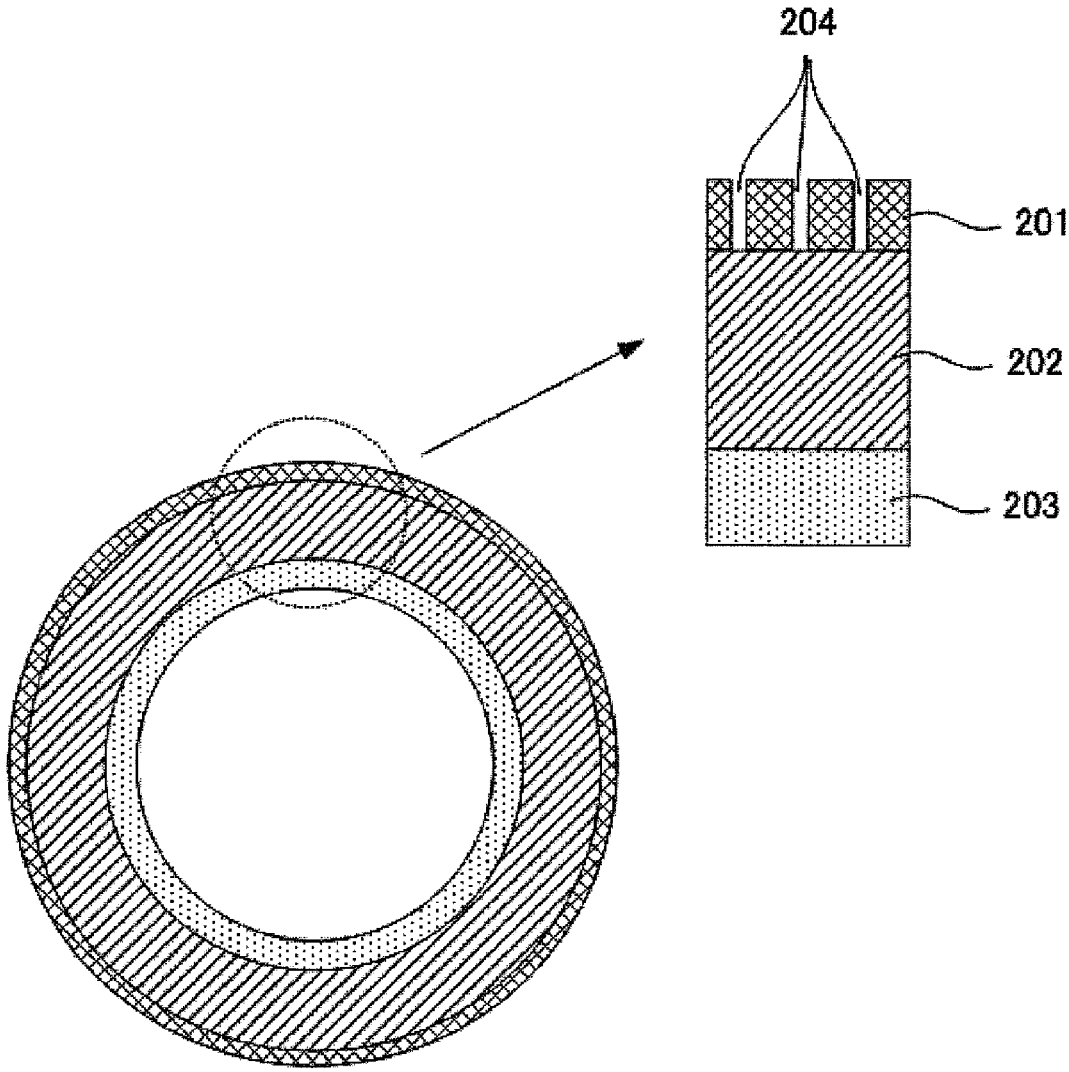
FIG. 2 includes a cross-sectional view and a partially enlarged cross-sectional view which show an example of a fixing member of the present invention.

Here, as shown in FIG. 2, the fixing member has a multilayer structure including a base material 203, an elastic layer 202 and a release layer 201, with the elastic layer 202 and the release layer 201 being sequentially formed over the base material 203.

Figure 3:
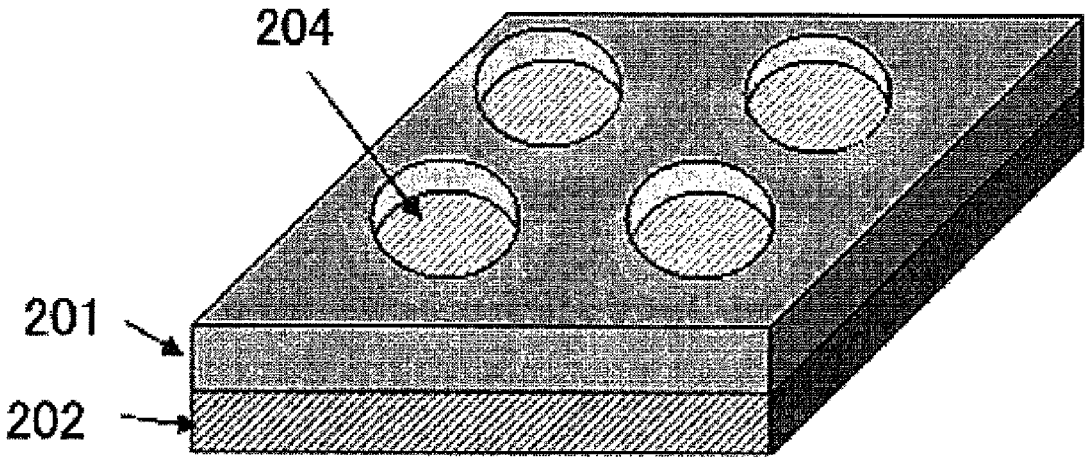
FIG. 3 is a perspective view showing an example of a fixing member of the present invention.

In the release layer 201 as the outermost layer, numerous through-holes 204 which reach the elastic layer 202 are formed at predetermined intervals as shown in FIGS. 2 and 3. The through-holes 204 preferably have a diameter of 0.0001 mm to 1 mm each, more preferably 0.2 μm to 50 μm each. When the through-holes 204 have a diameter of less than 0.0001 mm each, forceful cavitation cannot be adequately generated between melted toner and the fixing member. When the through-holes 204 have a diameter of greater than 1 mm each, an image defect may arise owing to uneven glossiness.

Figure 4A:
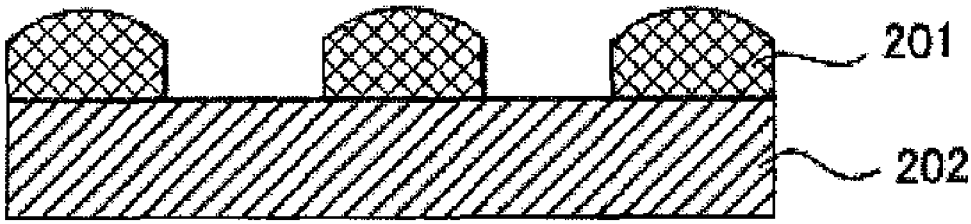
FIG. 4A is a drawing showing an example of a cross-sectional shape of through-holes formed in a release layer in a fixing member.
Figure 4B:
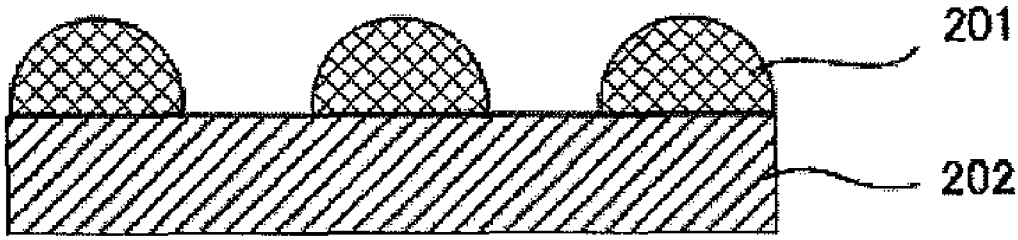
FIG. 4B is a drawing showing another example of a cross-sectional shape of through-holes formed in the release layer in the fixing member.
Figure 4C:
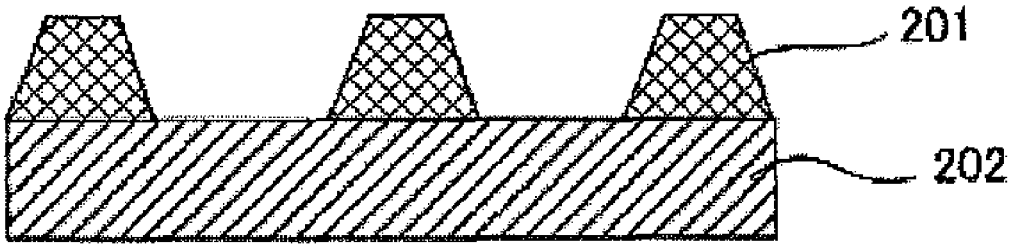
FIG. 4C is a drawing showing yet another example of a cross-sectional shape of through-holes formed in the release layer in the fixing member.

Regarding the cross-sectional shape of the through-holes (depressions), the edges of the through-holes may be perpendicular to the elastic layer as shown in FIG. 4A; besides, the edges thereof may be curved as shown in FIG. 4B or inclined as shown in FIG. 4C. Also, the planar shape of each through-hole is not limited to a circular shape but may also be an elliptical shape, a quadrangular shape, a polygonal shape, an indefinite shape, etc. The ratio of the total area of the through-holes to the overall area of the release layer is preferably in the range of 0.001:1 to 0.6:1, and more preferably in the range of 0.01:1 to 0.2:1.

(Method for Producing Fixing Member)

A method of the present invention for producing a fixing member includes a step of forming an elastic layer on a base material; a step of attaching powder onto the elastic layer; a step of forming a release layer over the powder; and a step (through-hole forming step) of removing the powder from a surface of the release layer so as to form a plurality of through-holes in the release layer. Further, the method may include other step(s) if necessary.

In the through-hole forming step, the powder may be removed, for example by rubbing the surface of the release layer with a dry cloth or rubbing it with sandpaper. Removal of the powder by rubbing the surface of the release layer with a dry cloth is particularly preferable in that the release layer is less scratched. Examples of the cloth include BEMCOT M-1 (manufactured by Asahi Kasei Corporation).

The powder is not particularly limited and may be suitably selected according to the purpose. Examples of the powder include PFA particles, PTFE particles, and inorganic powder particles with fluorinated surfaces (such as silica beads).

The powder preferably has an average particle diameter of 0.2 μm to 50 μm.

The powder is preferably attached onto the elastic layer by powder coating. Although the amount of the powder attached may be suitably adjusted according to the surface area of a member onto which the powder is attached, it is preferably in the range of 83 $g/m^2$ to 166 $g/m^2$.

(Fixing Device and Fixing Method)

A fixing device of the present invention includes the above-mentioned fixing member of the present invention and may if necessary include other member(s).

The fixing member may, for example, be in the form of a fixing belt or a fixing roller. The fixing belt is set between and supported by a support roller and a fixing auxiliary roller.

A fixing method of the present invention includes placing the release layer of the fixing member of the present invention in such a direction that the release layer touches an unfixed image formed with a developer, when the unfixed image is fixed to a recording medium.

Figure 5:
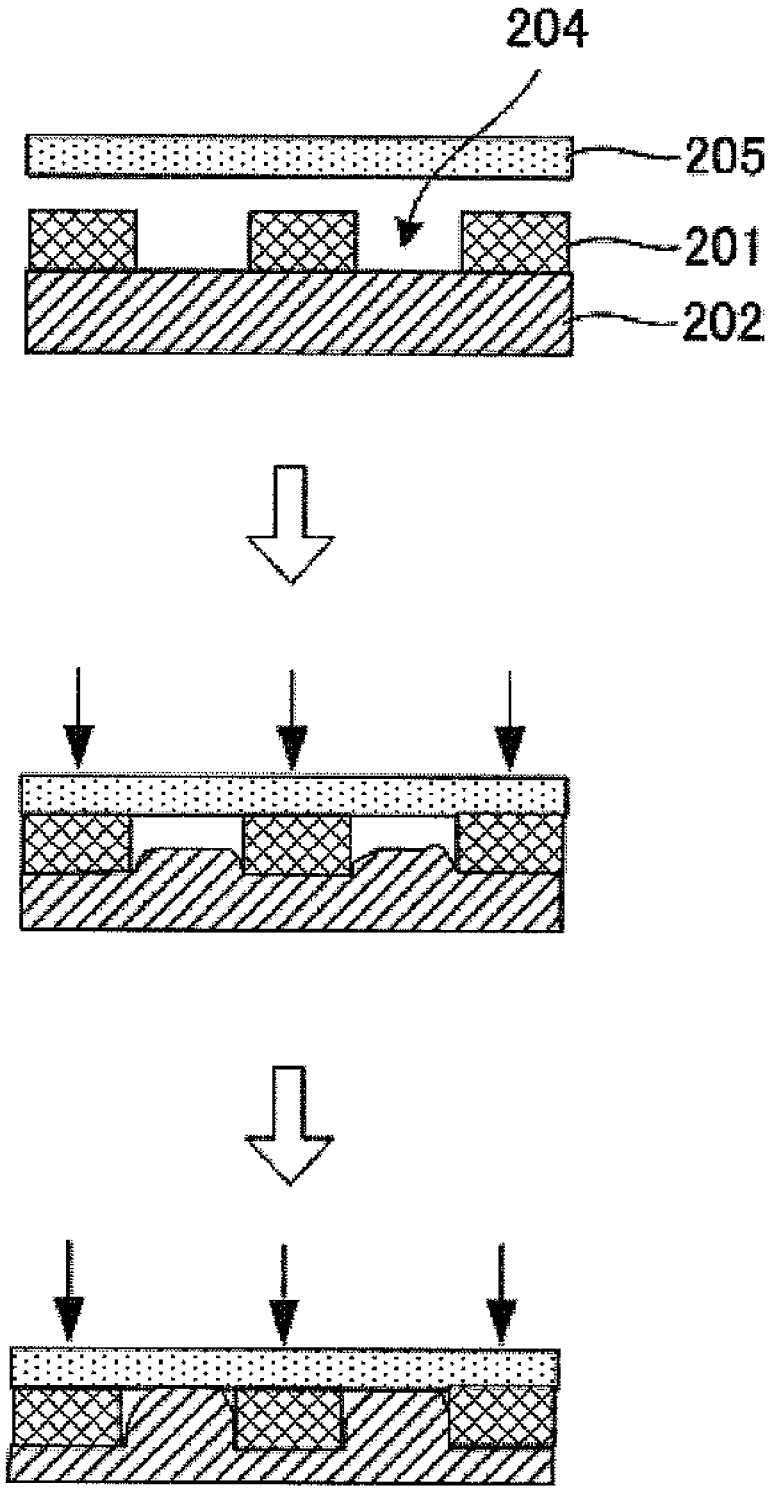
FIG. 5 is a process drawing showing an example of a fixing method using a fixing member of the present invention.

When the fixing member of the present invention is used, the release layer 201 as the outermost layer is pressed by a recording medium 205 at the time of nipping with pressurization for image fixation, part of the elastic layer 202 formed under the release layer 201 enters and fills the depressions 204 formed in the outermost layer, and thus a smooth pressing surface can be obtained, as shown in FIG. 5.

The depressions filled are preferably 2 μm or less, and more preferably 0.5 μm or less, in depth. When the depressions are greater than 2 μm in depth, transferred depressions in an image may cause uneven glossiness, which leads to an image defect.

Moreover, at the time of separation between the fixing member and the recording medium, the elastic layer returns to where it was when the pressure for image fixation is released from the depressions in the fixing member firmly attached to the recording medium during image fixation, the depressions are re-formed in the surface of the fixing member, which generates cavitation between melted toner and the fixing member and thus makes it possible to reduce forcefully the contact area between the recording medium and the fixing member and separate the recording medium from the fixing member, and consequently a stable fixing device which does not cause paper jams can be obtained.

Figure 6:
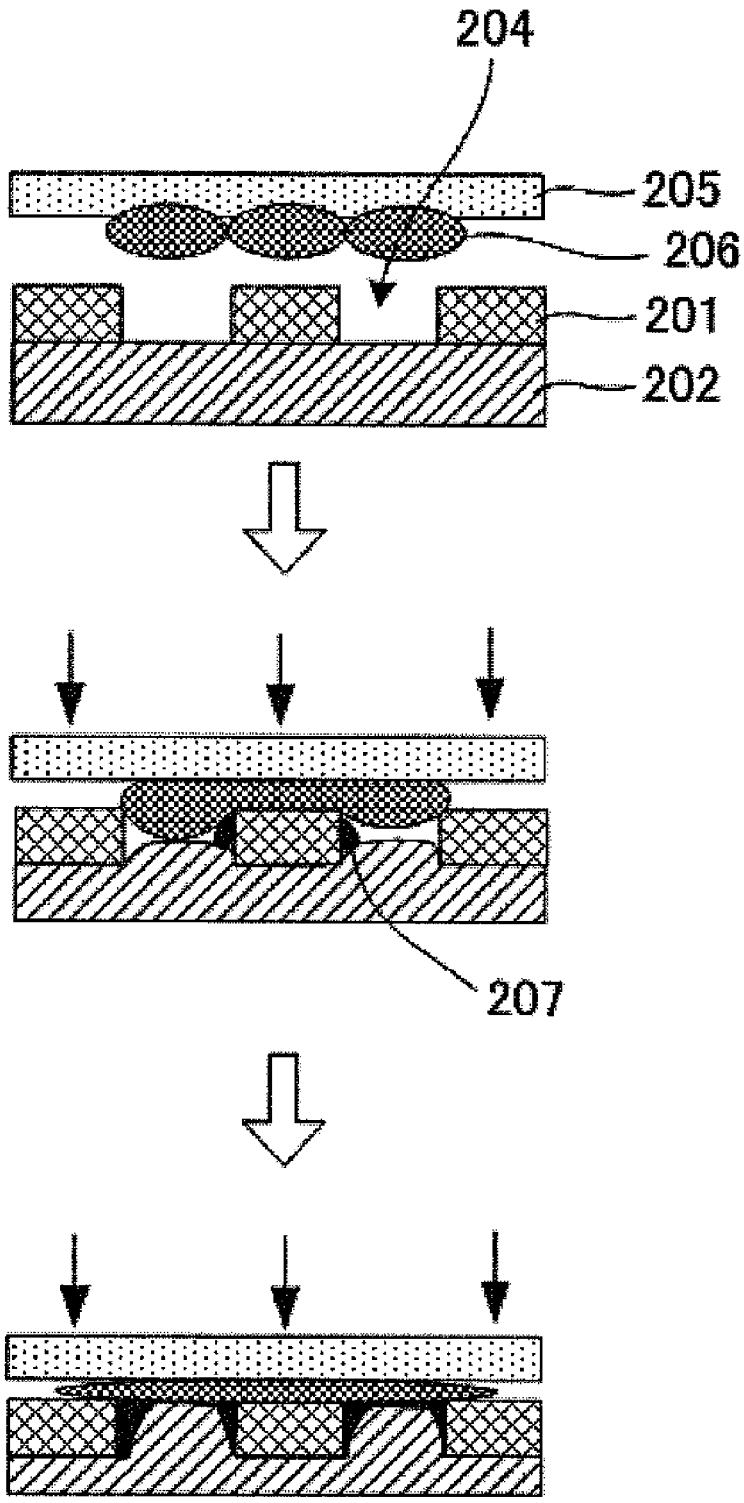
FIG. 6 is a process drawing showing an example of an image forming method using a fixing member of the present invention.

When a toner 206 is present on the recording medium 205, as shown in FIG. 6, the depressions 204 are filled by means of a mechanism similar to the one shown in FIG. 5, and a release agent contained in the toner 206 melts when heated. This melting release agent 207 moves preferentially to the elastic layer 202, which stems from the difference in wettability between the release layer 201 and the elastic layer 202, and the release agent 207 becomes wet there.

In the case where a release layer is a smooth surface made solely of fluorine resin as in related art, a melting release agent is repelled by the surface and thus the release layer has parts where the release agent is scarce. These parts where the release agent is scarce cause melted toner and a fixing member to fuse together, making the separation between a melted toner resin and the fixing member unstable, and consequently cause a paper jam and/or an image defect.

In the present invention, however, the entry of the release agent 207 into the evenly formed depressions 204 makes it possible to secure separation between the toner 206 and the fixing member and keep the release agent evenly on the fixing member; consequently, separation between the melting toner on the recording medium and the fixing member can be secured, and thus the incidence of image defects and paper jams can be reduced.

(Image Forming Apparatus)

An image forming apparatus mentioned in the present invention includes at least a latent electrostatic image bearing member, a latent electrostatic image forming unit, a developing unit, a transfer unit and a fixing unit. Further, if necessary, the image forming apparatus may include suitably selected other unit(s) such as a charge eliminating unit, a cleaning unit, a recycling unit and a control unit.

Here, the fixing unit is the above-mentioned fixing device of the present invention.

The latent electrostatic image forming unit is a unit configured to form a latent electrostatic image on the latent electrostatic image bearing member.

The material, shape, structure, size and the like of the latent electrostatic image bearing member (hereinafter otherwise referred to as "electrophotographic photoconductor", "photoconductor" or "image bearing member") are not particularly limited and may be suitably selected. Suitable examples of the shape include a drum-like shape, and examples of the material include inorganic photoconductor materials such as amorphous silicon and selenium and organic photoconductor materials such as polysilane and phthalopolymethine, with preference being given to amorphous silicon and the like in view of a long lifetime.

The latent electrostatic image can, for example, be formed by uniformly charging the surface of the latent electrostatic image bearing member and then exposing the surface imagewise, which can be carried out by the latent electrostatic image forming unit. The latent electrostatic image forming unit includes, for example, at least a charging device for uniformly charging the surface of the latent electrostatic image bearing member, and an exposing device for exposing the surface imagewise.

The charging can, for example, be performed by applying a voltage to the surface of the latent electrostatic image bearing member, using the charging device.

The charging device is not particularly limited and may be suitably selected according to the purpose. Examples of the charging device include known contact charging devices equipped with conductive/semiconductive rollers, brushes, films, rubber blades, etc., and non-contact charging devices utilizing corona discharge, such as corotron chargers and scorotron chargers.

The exposure can, for example, be performed by exposing the surface of the latent electrostatic image bearing member imagewise, using the exposing device.

The exposing device is not particularly limited as long as it can expose the surface of the latent electrostatic image bearing member charged by the charging device, such that an intended image will be formed on the surface, and the exposing device may be suitably selected according to the purpose. Examples thereof include exposing devices based upon a copy optical system, a rod lens array, a laser optical system, a liquid crystal shutter optical system, etc.

In the present invention, a back surface lighting method may be employed in which imagewise exposure is performed from the back surface side of the latent electrostatic image bearing member.

—Developing Unit—

The developing unit is a unit configured to develop the latent electrostatic image using a toner or a developer so as to form a visible image.

The visible image can be formed, for example by developing the latent electrostatic image using the toner or the developer, which can be carried out by the developing unit.

The developing unit is not particularly limited as long as it can develop the latent electrostatic image using the toner or the developer, and the developing unit may be suitably selected from known developing units. Examples thereof include a developing unit incorporating at least a developing device which houses the toner or the developer and is capable of supplying the toner or the developer to the latent electrostatic image in a contact or non-contact manner.

The developing device may be of dry developing type or of wet developing type and may be a developing device for a single color or a developing device for multiple colors. Examples thereof include a developing device incorporating an agitator for agitating the toner or the developer by friction and thus charging it, and also incorporating a rotatable magnetic roller.

In the developing device, for example, the toner and a carrier are mixed and agitated, and the toner is charged by the friction and is held in an upright position on the surface of the rotating magnetic roller, thereby forming a magnetic brush. Since the magnetic roller is placed in the vicinity of the latent electrostatic image bearing member (photoconductor), part of the toner constituting the magnetic brush formed on the surface of the magnetic roller moves to the surface of the latent electrostatic image bearing member (photoconductor) by electrical suction. As a result of it, the latent electrostatic image is developed with the toner, and a visible image composed of the toner is formed on the surface of the latent electrostatic image bearing member (photoconductor).

The developer housed in the developing device is a developer containing the toner, and the developer may be a one-component developer or two-component developer.

—Transfer Unit—

The transfer unit is a unit configured to transfer the visible image onto a recording medium. A preferred aspect of the transfer unit is such that an intermediate transfer member is used, a visible image is primarily transferred onto the intermediate transfer member and then the visible image is secondarily transferred onto the recording medium. A more preferred aspect of the transfer unit is such that toners of two or more colors, preferably full-color toners, are used, and there are provided a primary transfer unit configured to transfer visible images onto an intermediate transfer member so as to form a compound transfer image thereon, and a secondary transfer unit configured to transfer the compound transfer image onto a recording medium.

The intermediate transfer member is not particularly limited and may be suitably selected from known transfer members according to the purpose. Examples thereof include a transfer belt.

The transfer unit (primary transfer unit and secondary transfer unit) preferably includes at least a transfer device for charging and thus separating the visible image formed on the latent electrostatic image bearing member (photoconductor) toward the recording medium side. Regarding the transfer unit(s), one transfer unit, or two or more transfer units may be provided.

Examples of the transfer device include a corona transfer device utilizing corona discharge, a transfer belt, a transfer roller, a pressure transfer roller and an adhesion transfer device.

The recording medium is not particularly limited and may be suitably selected from known recording media (recording paper).

The fixing unit is a unit configured to fix the transferred visible image to the recording medium, using a fixing device. Toners of each color may be individually fixed upon transfer thereof to the recording medium; alternatively, the toners of each color may be fixed at one time in a superimposed state.

As the fixing unit, the above-mentioned fixing device of the present invention is used.

The charge eliminating unit is a unit configured to eliminate charge by applying a charge eliminating bias to the latent electrostatic image bearing member.

The charge eliminating unit is not particularly limited as long as it can apply a charge eliminating bias to the latent electrostatic image bearing member, and it may be suitably selected from known charge eliminating devices. Examples thereof include a charge eliminating lamp.

The cleaning unit is a unit configured to remove the toner remaining on the latent electrostatic image bearing member.

The cleaning unit is not particularly limited as long as it can remove the toner remaining on the latent electrostatic image bearing member, and it may be suitably selected from known cleaners. Suitable examples thereof include a magnetic brush cleaner, an electrostatic brush cleaner, a magnetic roller cleaner, a blade cleaner, a brush cleaner and a web cleaner.

The recycling unit is a unit configured to return the toner removed by the cleaning unit to the developing unit.

The recycling unit is not particularly limited and may, for example, be a known conveyance unit.

The control unit is a unit configured to control the above-mentioned units.

The control unit is not particularly limited as long as it can control operations of the above-mentioned units, and the control unit may be suitably selected according to the purpose. Examples thereof include apparatuses such as a sequencer and a computer.

FIG. 1A conceptually shows the structures of a photoconductor drum 101, an image forming system and a fixing device 5 in an image forming apparatus. Regarding an image forming process in this electrophotographic image forming apparatus, a photosensitive layer of the rotating photoconductor drum 101 is uniformly charged using a charging roller 102, then the photosensitive layer is exposed to a laser beam 103 coming from a laser scanning unit (not shown) such that a latent electrostatic image is formed on the photoconductor drum 101, the latent electrostatic image is developed with a toner so as to form a toner image, the toner image is transferred onto a recording sheet P, and the recording sheet P is passed through the fixing device 5 where the toner image is heated and pressurized so as to be fixed to the recording sheet. In FIG. 1A, the numeral 103 denotes exposure, the numeral 104 denotes a developing roller, the numeral 105 denotes a power pack (power source), the numeral 106 denotes a transfer roller, the numeral 107 denotes recording paper, the numeral 108 denotes a cleaning device and the numeral 109 denotes a surface electrometer.

This fixing device 5 uses a heating and fixing roller 110 provided with the above-mentioned fixing member of the present invention. As to this heating and fixing roller 110, a heater such as a halogen lamp is placed along the rotation center line in a hollow portion of a core metal, and the heating and fixing roller 110 is heated from inside by means of radiation heat emitted from the heater, which produces an effect of enhancing thermal efficiency.

Figure 1B:
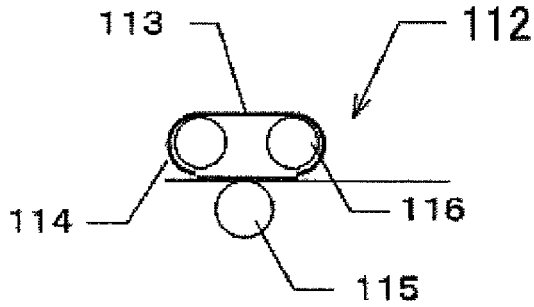
FIG. 1B is a drawing conceptually showing the structure of another fixing device.

In the fixing device 5, a pressurizing roller 111 which comes into contact with the heating and fixing roller 110 by pressure is provided parallel to the heating and fixing roller 110, and the recording sheet P is passed between the pressurizing roller 111 and the heating and fixing roller 110, thereby causing the toner attached onto the recording sheet P to soften utilizing the heat of the heating and fixing roller 110; while doing so, the toner image is fixed onto the recording sheet P by sandwiching the recording sheet P with the toner between the pressurizing roller 111 and the heating and fixing roller 110 for pressurization. Meanwhile, a belt-type fixing device 112 may be used. In FIG. 1B, the numeral 113 denotes a fixing belt, the numeral 114 denotes a fixing roller, the numeral 115 denotes a pressurizing roller and the numeral 116 denotes a tension roller (heating roller). The fixing belt is provided with the above-mentioned fixing member of the present invention.

Since the image forming apparatus uses the fixing device of the present invention with improved durability and reliability, it can be suitably used, for example as electrophotographic copiers, facsimiles, laser beam printers and so forth.

EXAMPLES

The following explains Examples of the present invention. It should, however, be noted that the present invention is not confined to these Examples in any way.

Example 1

A silicone primer layer as an underlayer was formed and dried on a cylindrical base material (made of a polyimide resin) having a length of 320 mm, a diameter of 60 mm and a thickness of 50 μm, then fluorosilicone rubber (X36-420U, manufactured by Shin-Etsu Chemical Co., Ltd.) was applied onto the silicone primer layer by blade coating, which was followed by heating at 150° C. for 10 minutes, and an elastic layer having a thickness of 200 μm was thus formed.

Next, 10 g of PFA particles (powdered fluorine resin, MP102, manufactured by DU PONT-MITSUI FLUORO-CHEMICALS COMPANY, LTD.) classified so as to have diameters of 0.1 μm to 50 μm (mainly 10 μm) were attached onto the elastic layer by powder coating.

Subsequently, a fluorine-based elastomer (SIFEL615C, manufactured by Shin-Etsu Chemical Co., Ltd.) was applied over the PFA particle layer, which was followed by heating at 150° C. for 60 minutes, and a release layer having a thickness of 5.0 μm was thus formed.

Next, a diluted solution (0.1% by mass) of OPTOOL HD (manufactured by DAIKIN INDUSTRIES, LTD), which was a fluorine-based carbon compound, was applied by dipping onto the release layer to modify the quality of the fluorine-containing surface of the release layer and kept at a relative humidity of 90% and a temperature of 80° C. for 30 minutes, which was followed by drying at 150° C. for 10 minutes, and a modifying layer having a thickness of 0.01 μm or less was thus formed.

Finally, the PFA particles were removed by rubbing the surface of the release layer (including the modifying layer) with a dry cloth (BEMCOT M-1, manufactured by Asahi Kasei Corporation), and through-holes were thus formed in the release layer. By the above-mentioned procedure, a fixing member of Example 1 was produced.

Regarding the obtained fixing member, the universal hardness of the release layer was 0.8 N/mm$^2$ (when an indenter had been pushed to a depth of 5 μm), and the universal hardness of the elastic layer was 0.2 N/mm$^2$ (when the indenter had been pushed to a depth of 5 μm). Here, using an ultra-micro hardness tester (WIN-HUD, manufactured by Fischer), the universal hardness of the elastic layer and that of the release layer were calculated by gradually pushing the indenter against the fixing member to a predetermined depth under the following conditions and utilizing the load and the contact area of the indenter at the time when the indenter had been pushed to the predetermined depth.

—Measurement Condition—

Indenter: diamond indenter in the shape of a quadrangular pyramid with a surface-facing angle of 136°

Initial load: 0.02 mN

Maximum load: 50 mN

Time spent in increasing load from initial load to maximum load: 10 seconds

Regarding the obtained fixing member, the receding contact angle of a surface of the release layer to purified water was 91°, and the receding contact angle of a surface of the elastic layer to purified water was 60°. Here, the receding contact angles were measured with water absorption at a rate of 6.0 μL/sec, using DROP MASTER DM 700 manufactured by Kyowa Interface Science Co., LTD, and stably obtained values were employed as the measurement values.

Also, when a quartz plate (thickness t=2 mm) was brought into contact with the surface of the fixing member by application of pressure (10 N/cm$^2$) and the height difference between a depression and a protrusion at the surface of the fixing member was measured in 10 places, the average height difference was 0.5 μm or less. Here, the height difference between a depression and a protrusion (level difference) was measured with a measurement pitch of 2 μm, using laser displacement meters (LT-9010M (laser output unit), LT-9500 (laser control unit) and STAGE KS-1100, manufactured by KEYENCE CORPORATION).

The produced fixing member was installed in a fixing device of a copier (MPC3000, manufactured by Ricoh Company, Ltd.) without mechanical separation function, and a test of forming solid images on 100,000 sheets of paper was carried out. Sabre-X80 (manufactured by JAwer) was used as the paper. The winding of the sheets and image defects (glossiness) were judged in accordance with the criteria shown in Table 1. The measurement of image defects (glossiness) was carried out using a glossmeter (PG-1, at an angle of 60°, manufactured by NIPPON DENSHOKU INDUSTRIES CO., LTD.). The results are shown in Table 2.

Example 2

A fixing member of Example 2 was produced in the same manner as in Example 1, except that, instead of the fluorosilicone rubber in the elastic layer, silicone rubber (DY35-2083, manufactured by Dow Corning Toray Co., Ltd.) was applied by blade coating so as to have a thickness of 200 μm, which was followed by heating at 150° C. for 30 minutes and then secondary vulcanization at 200° C. for 4 hours.

Regarding the obtained fixing member of Example 2, the universal hardness of the release layer was 0.8 N/mm$^2$ (when the indenter had been pushed to a depth of 5 μm), and the universal hardness of the elastic layer was 0.4 N/mm$^2$ (when the indenter had been pushed to a depth of 5 μm).

Also regarding the obtained fixing member of Example 2, the receding contact angle of the surface of the release layer to purified water was 91°, and the receding contact angle of the surface of the elastic layer to purified water was 76°. When the quartz plate was brought into contact with the surface of the obtained fixing member of Example 2, the average height difference was 0.5 μm or less. Evaluations of the winding of the sheets and image defects (glossiness) were carried out on the obtained fixing member of Example 2 in the same manner as in Example 1. The results are shown in Table 2.

Example 3

A fixing member of Example 3 was produced in the same manner as in Example 1, except that, instead of the fluorine-based elastomer in the release layer, a fluorine-based carbon compound (OPTOOL HD, manufactured by DAIKIN INDUSTRIES, LTD, diluted solution (1.0% by mass)) was only applied by dipping and kept at a relative humidity of 90% and a temperature of 80° C. for 30 minutes, which was followed by drying at 150° C. for 10 minutes, and a release layer having a thickness of 0.02 μm was thus formed.

Regarding the obtained fixing member of Example 3, the universal hardness of the release layer was 0.2 N/mm$^2$ (when the indenter had been pushed to a depth of 5 μm), and the universal hardness of the elastic layer was 0.2 N/mm$^2$ (when the indenter had been pushed to a depth of 5 μm).

Also regarding the obtained fixing member of Example 3, the receding contact angle of the surface of the release layer to purified water was 90°, and the receding contact angle of the surface of the elastic layer to purified water was 60°. When the quartz plate was brought into contact with the surface of the obtained fixing member of Example 3, the average height difference was 0.5 μm or less.

Evaluations of the winding of the sheets and image defects (glossiness) were carried out on the obtained fixing member of Example 3 in the same manner as in Example 1. The results are shown in Table 2.

Example 4

A fixing member of Example 4 was produced in the same manner as in Example 1, except that, instead of the fluorosilicone rubber (X36-420U, manufactured by Shin-Etsu Chemical Co., Ltd.) in the elastic layer, silicone rubber (X-34-2396, manufactured by Shin-Etsu Chemical Co., Ltd.) was formed so as to have a thickness of 200 μm, and that, instead of the fluorine-based elastomer (SIFEL615C, manufactured by Shin-Etsu Chemical Co., Ltd.) in the release layer, fluorosilicone rubber (X36-420U, manufactured by Shin-Etsu Chemical Co., Ltd.) was formed so as to have a thickness of 5 μm.

Regarding the obtained fixing member of Example 4, the universal hardness of the release layer was 0.2 $N/mm^2$ (when the indenter had been pushed to a depth of 5 μm), and the universal hardness of the elastic layer was 0.7 $N/mm^2$ (when the indenter had been pushed to a depth of 5 μm).

Also regarding the obtained fixing member of Example 4, the receding contact angle of the surface of the release layer to purified water was 60°, and the receding contact angle of the surface of the elastic layer to purified water was 75°.

When the quartz plate was brought into contact with the surface of the obtained fixing member of Example 4, the average height difference was 2.0 μm.

Evaluations of the winding of the sheets and image defects (glossiness) were carried out on the obtained fixing member of Example 4 in the same manner as in Example 1. The results are shown in Table 2.

Comparative Example 1

A silicone primer layer as an underlayer was formed and dried on a cylindrical base material (made of a polyimide resin) having a length of 320 mm, a diameter of 60 mm and a thickness of 50 μm, then silicone rubber (DY35-2083, manufactured by Dow Corning Toray Co., Ltd.) was applied onto the silicone primer layer by blade coating so as to have a thickness of 200 μm, which was followed by heating at 150° C. for 30 minutes and then secondary vulcanization at 200° C. for 4 hours, and a fixing member of Comparative Example 1 was thus produced.

Evaluations of the winding of the sheets and image defects (glossiness) were carried out on the obtained fixing member of Comparative Example 1 in the same manner as in Example 1. The results are shown in Table 2.

Comparative Example 2

A fixing member of Comparative Example 2 was produced in the same manner as in Comparative Example 1, except that a carbon-added conductive fluorine resin primer (manufactured by DU PONT-MITSUI FLUOROCHEMICALS COMPANY, LTD.) was applied onto a silicone rubber layer (elastic layer), PFA particles (powdered fluorine resin, MP102, manufactured by DU PONT-MITSUI FLUOROCHEMICALS COMPANY, LTD.) were applied over the primer by powder coating, these components were fired at 340° C. for 30 minutes in a furnace and then removed from the furnace so as to be cooled, and a release layer having a thickness of 10 μm was thus formed.

Evaluations of the winding of the sheets and image defects (glossiness) were carried out on the obtained fixing member of Comparative Example 2 in the same manner as in Example 1. The results are shown in Table 2.

TABLE 1

| | Content | Rank regarded as successful | Criteria for ranks 1 to 4 |
|---|---|---|---|
| Winding | Number of times winding-related paper jam occurred | 3 or above | 1: 20 times or more<br>2: 10 times to 19 times<br>3: once to 9 times<br>4: not occurred |
| Image defects (Glossiness) | Ratio of area which met standard of glossiness, regarding output image formed for the first time after test of forming images on sheets was over | 3 or above | 1: 10% or less<br>2: 10% or more but less than 50%<br>3: 50% or more<br>4: 100% |

TABLE 2

| | Winding | Image defects (Glossiness) |
|---|---|---|
| Example 1 | 4 | 4 |
| Example 2 | 4 | 3 |
| Example 3 | 4 | 3 |
| Example 4 | 4 | 3 |
| Comparative Example 1 | 1 | 1 |
| Comparative Example 2 | 1 | 2 |

The results shown in Table 2 demonstrate that Comparative Example 1 could not achieve ranks regarded as successful in terms of both "winding" and "image defects". It is inferred that the failure to achieve a successful rank in terms of "winding" stemmed from the inability to secure sufficient separation between the fixing member and the transfer paper with the melted toner, and that the failure to achieve a successful rank in terms of "image defects" was mainly due to the non-uniform separation of the melted toner from the fixing member and the resultant roughness and raggedness of the surface of the fixed image caused at the time of the separation.

Meanwhile, Comparative Example 2 was superior to Comparative Example 1 in "image defects" but still failed to achieve a successful rank. Also, Comparative Example 2 failed to achieve a successful rank in terms of "winding". It is inferred that Comparative Example 2 was superior to Comparative Example 1 in "image defects" because separation of the melted toner from the fixing member was somewhat secured due to the non-adhesiveness of the fluorine resin, which was, however, deemed insufficient to achieve a successful rank. It is inferred that the failure to achieve a successful rank in terms of "winding" was mainly caused by the electrostatic adhesion of the recording medium making the separating performance unstable.

In contrast, Examples 1 to 4 reduced the incidence of both winding and image defects and achieved successful ranks.

Thus, it is possible to reduce the incidence of image defects and paper jams by installing the fixing member of the present invention in the fixing device. Specifically, a release agent enters the evenly-formed depressed elastic portions, which makes it possible to keep the release agent evenly on the fixing member and maintain separation between the melted toner on the recording medium and the fixing member. Moreover, at the time of separation between the fixing member and the recording medium, the elastic layer returns to where it was when the pressure for image fixation is released from the depressions in the fixing member firmly attached to the recording medium during image fixation, the depressions are re-formed in the surface of the fixing member, which generates cavitation forcefully between the melted toner and the fixing member and thus makes it possible to reduce the contact area between the recording medium and the fixing member and separate the recording medium from the fixing member. This means that a stable fixing device which does not cause paper jams can be obtained.

Furthermore, the release layer is pressed by the recording medium at the time of nipping with pressurization for image fixation, the elastic layer formed under the release layer enters and fills the depressions formed in the release layer, and thus a smooth pressing surface can be obtained; consequently, a high-quality image superior in glossiness can be obtained.

The fixing member of the present invention makes it possible to provide a fixing device with improved durability and reliability, which can be utilized for electrophotographic copiers, facsimiles, laser beam printers, etc. with high durability and reliability, and can thus contribute to reduction in environmental loads and improvement in customer satisfaction.

What is claimed is:

1. A fixing member for fixing to a recording medium an unfixed image formed with a developer, the fixing member comprising:

a base material;

an elastic layer which is provided outside the base material and has an elastic deformation property; and a release layer which is provided outside the elastic layer and promotes separation of the recording medium from the fixing member, wherein the release layer has a plurality of through-holes formed between its front surface and its surface on the opposite side to the front surface, and part of the elastic layer in contact with the release layer can fill the through-holes upon provision of pressure for fixing the unfixed image to the recording medium.

2. The fixing member according to claim 1, wherein the part of the elastic layer in contact with the release layer fills the through-holes upon the provision of the pressure for fixing the unfixed image to the recording medium, and the front surface of the release layer forms a smooth surface when the unfixed image is pressurized for its fixation.

3. The fixing member according to claim 1, wherein the base material in the fixing member has a hollow structure in a cylindrical shape, and a heating medium is provided in the hollow structure.

4. The fixing member according to claim 1, wherein a material constituting the release layer contains a fluorine-based polymer.

5. The fixing member according to claim 1, wherein a material constituting the elastic layer is a rubber material.

6. The fixing member according to claim 5, wherein the rubber material has a molecular arrangement whose main-chain component contains siloxane bonds.

7. The fixing member according to claim 5, wherein the rubber material is fluorosilicone rubber.

8. The fixing member according to claim 1, wherein the universal hardness of the elastic layer is equal to or lower than the universal hardness of the release layer.

9. The fixing member according to claim 8, wherein the difference between the universal hardness of the release layer and the universal hardness of the elastic layer is in the range of 0 $N/mm^2$ to 3.75 $N/mm^2$.

10. The fixing member according to claim 1, wherein the receding contact angle of a surface of the elastic layer to purified water is smaller than the receding contact angle of a surface of the release layer to purified water.

11. The fixing member according to claim 10, wherein the difference between the receding contact angle of the surface of the release layer to purified water and the receding contact angle of the surface of the elastic layer to purified water is in the range of 0.1° to 70° .

12. The fixing member according to claim 1, wherein the base material has a thickness of 30 μm to 500 μm.

13. The fixing member according to claim 1, wherein the release layer has a thickness of 0.01 μm to 5 μm.

14. The fixing member according to claim 1, wherein the through-holes have a diameter of 0.0001 mm to 1 mm each.

15. The fixing member according to claim 1, wherein the ratio of the total area of the through-holes to the overall area of the release layer is in the range of 0.001:1 to 0.6:1.

16. A method for producing a fixing member, comprising:

(a) forming an elastic layer on a base material;

(b) attaching powder onto the elastic layer;

(c) forming a release layer over the powder; and (4) removing the powder from a surface of the release layer so as to form a plurality of through-holes in the release layer, wherein the plurality of through-holes are formed in (d) between a front surface of the release layer and a surface of the release layer on the opposite side to the front surface, and part of the elastic layer in contact with the release layer can fill the through-holes upon provision of pressure for fixing the unfixed image to the recording medium.

17. The method according to claim 16, wherein the powder is removed by rubbing the surface of the release layer with a dry cloth.

18. The method according to claim 16, wherein the powder has an average particle diameter of 0.2 μm to 50 μm.

19. The method according to claim 16, wherein the amount of the powder attached is in the range of 83 $g/m^2$ to 166 $g/m^2$.

20. A fixing device comprising:

a fixing member for fixing to a recording medium an unfixed image formed with a developer, which comprises a base material, an elastic layer which is provided outside the base material and has an elastic deformation property, and a release layer which is provided outside the elastic layer and promotes separation of the recording medium from the fixing member, wherein the release layer has a plurality of through-holes formed between its front surface and its surface on the opposite side to the front surface, and part of the elastic layer in contact with the release layer can fill the through-holes upon provision of pressure for fixing the unfixed image to the recording medium.

* * * * *